US009334027B1

(12) United States Patent
Daniels

(10) Patent No.: US 9,334,027 B1
(45) Date of Patent: May 10, 2016

(54) DRAG-REDUCING SURFBOARD FIN

(71) Applicant: Peter Jake Daniels, San Anselmo, CA (US)

(72) Inventor: Peter Jake Daniels, San Anselmo, CA (US)

( * ) Notice: Subject to any disclaimer, the term of this patent is extended or adjusted under 35 U.S.C. 154(b) by 0 days.

(21) Appl. No.: 13/999,055

(22) Filed: Jan. 7, 2014

(51) Int. Cl.
*B63B 1/32* (2006.01)
*B63B 35/79* (2006.01)

(52) U.S. Cl.
CPC ..... *B63B 35/7926* (2013.01)

(58) Field of Classification Search
CPC ..... B63B 35/7926; B63B 35/79
See application file for complete search history.

(56) References Cited

U.S. PATENT DOCUMENTS

D437,907 S * 2/2001 Stuart et al. ..... D21/778
7,685,959 B1 * 3/2010 Sanders ..... 114/288

* cited by examiner

*Primary Examiner* — Edwin Swinehart
(74) *Attorney, Agent, or Firm* — Risto A. Rinne, Jr.

(57) ABSTRACT

An apparatus for providing stability and reduced turbulence to a surfboard that is moving along its longitudinal axis includes at least one opening that passes through a surfboard fin when viewed from the side. When viewed in cross-section, each opening includes an optimized tapering profile that extends around an interior perimeter of the opening which reduces turbulence, and thereby lessens drag when the surfboard is moving forward in the water in a direction that is parallel to a center longitudinal axis of the surfboard and fin. The apparatus also significantly reducing side to side resistance when turning the surfboard.

15 Claims, 3 Drawing Sheets

DRAG-REDUCING SURFBOARD FIN

RESERVATION OF RIGHTS

A portion of the disclosure of this patent document contains material which is subject to intellectual property rights such as but not Limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to surfing and, more particularly, to a surfboard fin that reduces turbulence and, therefore, drag.

Surfboard fins provide a known way to stabilize a surfboard when the surfboard is moving straight ahead.

However, stabilizing fins create increased resistance to lateral displacement of the rear of a surfboard in water, where the fin is located, such as when attempting to turn (i.e., change the direction of) the surfboard.

Yet, it is extremely important for a surfer to be able to quickly change direction (i.e., to turn) while surfing in order to optimize and prolong the duration of the ride. The surfer must maintain careful position of the surfboard with respect to the base of the wave in order to maximize the transference of energy from the wave to the surfboard.

To facilitate turning, openings in the fin have been provided, such as shown in Design Pat. D437,907. However, prior types of openings create excessive turbulence within the openings as the surfboard moves forward along its longitudinal axis. This increased turbulence increases drag which, in turn, slows the surfboard down. This, in turn, limits forward speed for any given set of conditions. It also makes it somewhat more difficult to initiate forward movement when attempting to "catch" a wave.

Many surfboards today accept interchangeable fins. Therefore, surfers are able to change the fin that they are using. In this manner fins of different size and shape can be quickly and easily interchanged. This is done to optimize the configuration of the surfboard with existing surf conditions or to modify the surfboard's configuration to better adapt it to changing surf conditions.

Ideally, a drag-reducing surfboard fin that reduced turbulence while providing enhanced turning ability is desirable. Furthermore, it is additionally desirable to be able to provide various shapes and sizes of surfboard fins for interchangeable attachment to a surfboard to optimize the performance characteristics of the surfboard to current or changing surf conditions while optimally reducing turbulence and, thereby, decreasing drag for any size or shape of fin.

Accordingly, there exists today a need for a drag-reducing surfboard fin that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty.

Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Surfboard fins are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 6,322,413 to Webber, that issued on Nov. 27, 2001.

And including U.S. Design Patents:

U.S. Design Pat. No. D680,182 to Holliday, that issued on Apr. 16, 2013;

U.S. Design Pat. No. D631,927 to Potter, that issued on Feb. 1, 2011;

U.S. Design Pat. No. D593,176 to Stockstill, that issued on May 26, 2009;

U.S. Design Pat. No. D568,429 to Takayama, et al., that issued on May 6, 2008;

U.S. Design Pat. No. D546,752 to Dovell, that issued on Jul. 17, 2007;

U.S. Design Pat. No. D528,166 to Wright, that issued on Sep. 12, 2006; and

U.S. Design Pat. No. D437,907 to Stuart, et al., that issued on Feb. 20, 2001.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a drag-reducing surfboard fin that reduces drag when a surfboard is moving in a forward direction that is parallel to a center longitudinal axis of the surfboard or fin.

It is also an important object of the invention to provide a drag-reducing surfboard fin that reduces drag when a surfboard is turning in water and a rear portion of the surfboard is being urged by a surfer on the surfboard in a sideways or lateral direction that is generally perpendicular with respect to a center longitudinal axis of the surfboard or fin.

Another object of the invention is to provide a drag-reducing surfboard fin that includes at least one opening through the fin that facilitates turning of the surfboard in water.

Still another object of the invention is to provide a drag-reducing surfboard fin that reduces turbulence in an opening that is provided through the fin.

Still yet another object of the invention is to provide a drag-reducing surfboard fin that reduces turbulence in a plurality of openings that are provided through the fin.

Yet another important object of the invention is to provide a drag-reducing surfboard fin that reduces turbulence and, thereby, reduces drag.

Still yet another important object of the invention is to provide a drag-reducing surfboard fin that includes one or more openings through the fin that include any desired shape, such as round, oval, or any other geometric shape when viewed from the side of the fin.

A first continuing object of the invention is to provide a drag-reducing surfboard fin that is detachably-attachable with respect to a surfboard using any preferred method of attachment.

Briefly, a drag-reducing surfboard fin that is constructed in accordance with the principles of the present invention has at least one opening that passes through a surfboard fin when viewed from the side. When viewed in cross-section, the opening(s) each include an optimized tapering that extends around an interior perimeter of the opening(s) that reduces turbulence, and thereby drag, when the surfboard is moving forward in the water in a direction that is parallel to a center longitudinal axis of the surfboard and fin while also significantly reducing resistance when changing direction.

DETAILED DESCRIPTION OF THE INVENTION

Figure 1:
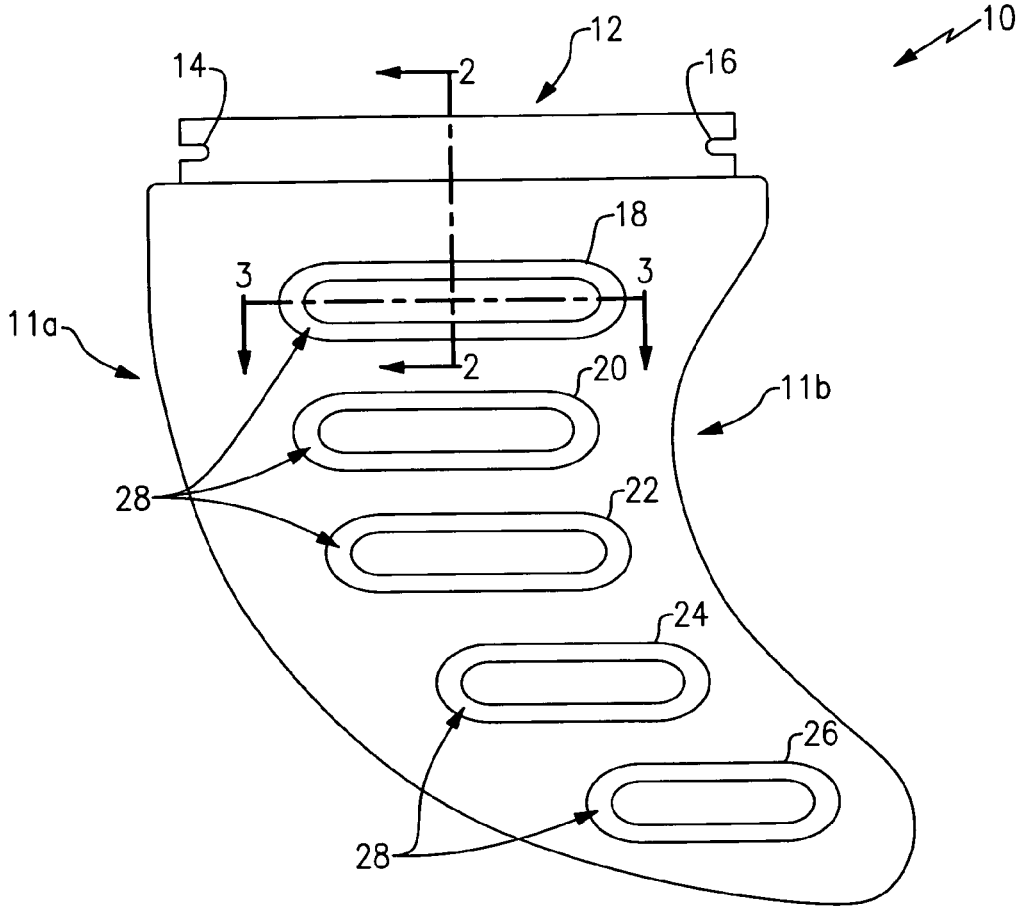
FIG. 1 is a side view of a drag-reducing surfboard fin.

Referring on occasion to all of the FIGURE drawings and now, in particular to FIG. 1, is shown a drag-reducing surfboard fin (herein after referred to as the "surfboard fin") and identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The surfboard fin 10 includes a forward edge as identified in general by reference numeral 11*a* and a rear edge, as identified in general by reference numeral 11*b*. The forward and rear edges 11*a*, 11*b* may include any desired profile, contour, size, thickness or tapering, as desired.

The surfboard fin 10 includes a mounting assembly, identified in general by the reference numeral 12. The mounting assembly 12 is attached to a remainder of the surfboard fin 10 by any preferred method, such as being molded integral with the remainder of the surfboard fin 10, as well as by any other preferred attachment method.

The mounting assembly 12, as shown, is a common type that is urged into a forward end of a fin opening provided in a bottom of surfboard (not shown) until a forward recess 14 engages with a member in the fin opening. The surfboard fin 10 is then rotated upward around the member until a rear recess 16, disposed proximate an upper end of a rear of the surfboard fin 10 is also fully disposed in the fin opening.

A fastener (not shown) is then tightened to secure the surfboard fin 10 to the fin opening and, accordingly, to the surfboard. To remove the surfboard fin 10 the above-described process is reversed.

As desired, the surfboard fin 10 can be replaced in a matter of minutes with another surfboard fin (see, for example, FIG. 4, which shows a first modified surfboard fin 100) or the first modified surfboard fin 100, could be replaced with the surfboard fin 10 or with any other configuration of the current invention that is desired. In this manner, the performance characteristics of the surfboard can be quickly modified to optimize performance of the surfboard to better correspond with current or changing surf conditions.

As desired, the mounting assembly 12 can be modified to correspond to any of the different mounting systems 12 as may be used by any prior, current or future surfboard manufacturer. In this manner, the surfboard fin 10 can be used to replace any existing or future type of detachably-attachable stabilizing fin as may be found on any surfboard.

In this manner, the surfboard fin 10 can be used to replace any OEM type of stabilizing fin that is detachably-attachable with respect to the surfboard. It is also possible and especially desirable to include the surfboard fin 10 as the OEM stabilizing fin that is supplied with the surfboard by the manufacturer.

A plurality of oval-shaped openings includes a first opening 18, a second opening 20, a third opening 22, a fourth opening 24, and a fifth opening 26 (when viewed from the side) that are included in the surfboard fin 10.

Figure 2:
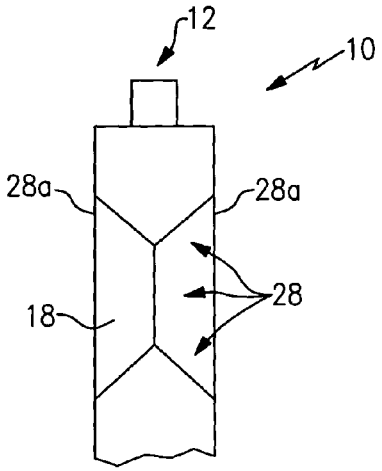
FIG. 2 is a cross sectional view taken on the line 2-2 in FIG. 1.

Referring now to FIG. 2, is shown a tapering profile, identified in general by the reference numeral 28, of a forward portion of the first opening 18 that extends fully along the interior perimeter of the first opening 18. Each of the remaining openings 20-26 also includes a similar tapering profile 28, although the contour, shape and length of each tapering profile 28 is adjusted for each opening 18-26 to optimally reduce turbulence for that particular opening size, shape and location.

Figure 3:
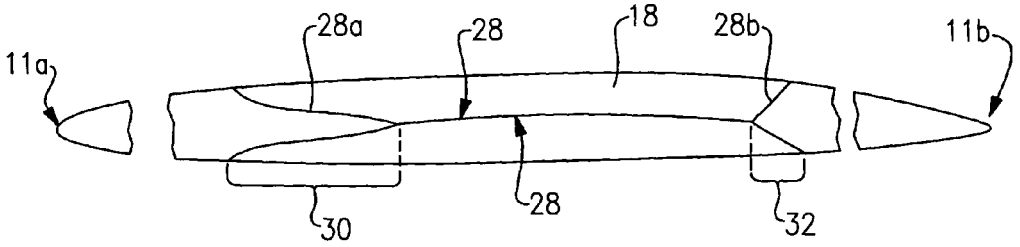
FIG. 3 is a cross sectional view taken on the line 3-3 in FIG. 1.

Referring now to FIG. 3, is shown the tapering profile 28 of a lower portion of the first opening 18. The forward and rear edges 11*a*, 11*b* are shown with one possible leading and trailing edge profile, although any desired profile, contour, size, thickness or tapering of the forward and rear edges 11*a*, 11*b* is possible.

A leading edge 28*a* of the tapering profile 28 includes a first longitudinal length, as shown by bracket 30. A trailing edge 28*b* of the tapering profile 28 includes a second longitudinal length, as shown by bracket 32. The first longitudinal length of the leading edge 28*a*, as shown, is longer than the second longitudinal length of the trailing edge 28*b*. This represents but one possible tapering profile 28 that is possible. If desired, the second longitudinal length could be longer than the first longitudinal length or, instead of coming to a line along an edge as shown, a rounded or radius edge could be included along the interior perimeter of the first opening 18 (or any of the remaining openings 20-26).

The longitudinal length and contour of the leading edge 28*a* and of the trailing edge 28*b* as well as the shape of any portion of the tapering profile 28 are adjusted as shown by experiment and/or computer modeling to provide minimum turbulence in the openings 18-26 as the surfboard moves in a forward direction in the water at the speeds most likely to be encountered during use. The shape, size and contour of the tapering profile 28 may also be modified to provide reduced turbulence in the openings 18-26 while turning as well as when going straight.

Additionally, the tapering profile 28 can be further modified to accommodate a range of surfing abilities ranging from novice to expert and the likely speeds that each ability range is likely to experience, thereby optimally minimizing turbulence and lessening drag for each ability range.

When a plurality of the openings 18-26 are included, the size and shape of each of the openings 18-26 is chosen to optimize ability to turn while minimizing the amount of turbulence caused by any of the openings 18-26 when going straight, and as mentioned above, preferably also when turning. Additional discussion as to the size and shape of the openings 18-26 is included, hereinafter.

Figure 4:
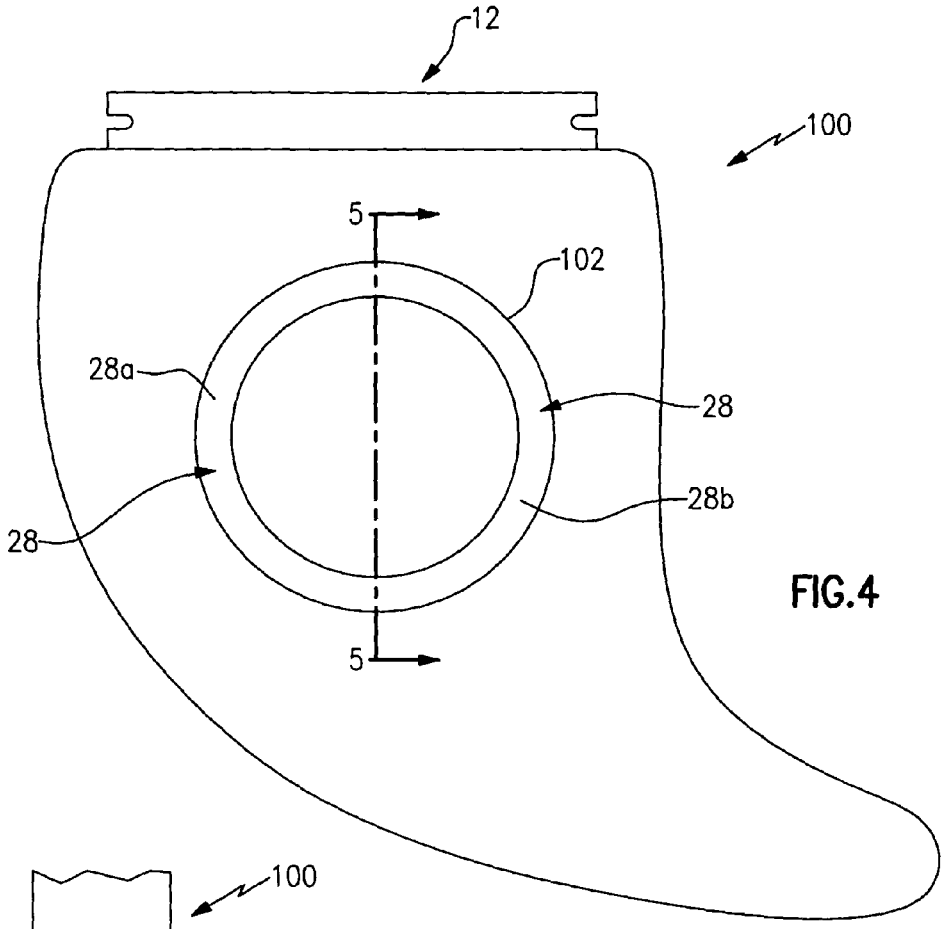
FIG. 4 is a side view of a first modified drag-reducing surfboard fin.

Referring now to FIG. 4 is shown a circular opening 102 in a first modified drag-reducing surfboard fin (hereinafter referred to as the "first modified surfboard fin"), as identified in general by reference numeral 100. This illustrates that any shape opening is possible for use with the current invention.

If desired, other geometric shapes, such as triangles, rectangles, squares, trapezoids, pentagons, polygonal shapes or any preferred combination, thereof, can be used for any of the openings 18-26, 102, as desired and that any desired overall size for any version of the surfboard fin 10 or the first modified surfboard fin 100 is also possible.

Similarly, the overall exterior size and shape of the surfboard fin 10 or the first modified surfboard fin 100 can be modified, as desired, or changed in scale, as desired. Specifically, the surfboard fin 10 or the first modified surfboard fin 100 (or any variation, thereof) can be any desired size or shape.

For certain types of surfboards and surf conditions a larger fin 10, 100 may be preferred, whereas for different types of surfboards or conditions a smaller fin 10, 100 may be preferred. Similarly, whatever taper or profile is optimally preferred for the forward edge 11*a* (also sometimes referred to as a leading edge) and for the rear edge 11*b* (also sometimes referred to as a trailing edge) is also possible.

Additionally, the overall shape, when viewed from the side, of the surfboard fin 10 or the first modified surfboard fin 100 (or any variation, thereof) are also anticipated. Review of the currently know design and utility patents provides guidance as to how the surfboard fin 10 or the first modified surfboard fin 100 (or any variation, thereof) of the current invention can be further adapted or modified to optimize performance for virtually all different types of surfboards and surf conditions.

Figure 5:
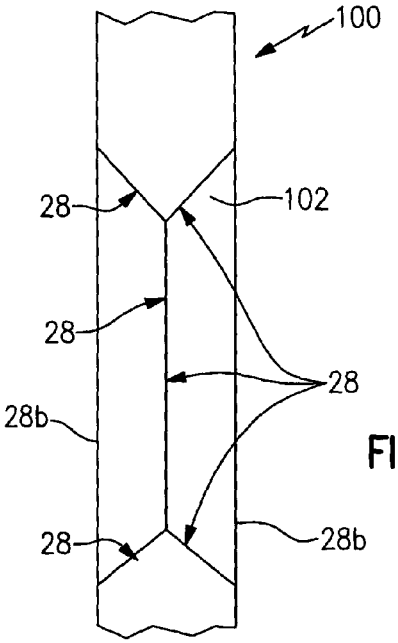
FIG. 5 is a cross sectional view taken on the line 5-5 in FIG. 4.

Referring to FIG. 5, is shown, the tapering profile 28 of the first modified surfboard fin 100. It is to be understood that any aspect of the tapering profile 28 can be varied to optimize turning ability while minimizing turbulence when moving forward or while turning and, therefore, drag of the first modified surfboard fin 100.

Accordingly, the upper portion or the lower portion, or the leading edge 28*a* (FIG. 4) or the trailing edge 28*b* of the tapering profile 28 of the circular opening 102 can be individually and independently modified to optimize performance of the first modified surfboard fin 100.

If desired, additional circular openings (not shown) or additional differently shaped openings (not shown) can be included with the first modified surfboard fin 100 or, if desired, with the surfboard fin 10 or any variation, thereof.

Experimentation and/or computer modeling will determine for each particular version utilizing the teachings of the current invention whether performance is maximally optimized through the use of a single larger opening (as taught by FIG. 4) or by the use of multiple smaller openings (as taught by FIG. 1) and, additionally, what shape or shapes (when viewed from the side) are preferred for the single larger opening or for each of the multiple smaller openings.

It is important to understand that for any version of the current invention the single larger opening as well as each of the multiple smaller openings will include the tapering profile 28 as this element disposed along the interior perimeter of the opening(s) is what reduces turbulence and, therefore, drag.

Again, for each particular version utilizing the teachings of the current invention experimentation and/or computer modeling will determine how to optimally configure (i.e., shape) the tapering profile 28 that is included in the single larger opening or in each of the multiple smaller openings.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A drag-reducing surfboard fin for use with a surfboard, comprising:

(a) a substantially planar member having a leading edge and an opposite trailing edge and a center longitudinal axis wherein said leading edge is disposed closer toward a direction of movement by the surfboard than said trailing edge;

(b) means for attaching said planar member to a bottom of the surfboard;

(c) at least one opening disposed in said planar member; and (d) a tapering profile that extends around an inside perimeter of said at least one opening, wherein a first side of said tapering profile extends from a first outside surface that is disposed on a first side of said planar member proximate said at least one opening toward a center of said at least one opening and wherein an opposite second side of said tapering profile extends from an opposite second outside surface that is disposed on an opposite second side of said planar member proximate said at least one opening toward said center of said at least one opening, and wherein said first side of said tapering profile and said second side of said tapering profile intersect at an edge, and wherein said edge extends fully around said inside perimeter of said at least one opening; and wherein said tapering profile includes a leading edge and an opposite trailing edge, and wherein said leading edge of said tapering profile includes a first longitudinal length and wherein said trailing edge of said tapering profile includes a second longitudinal length, and wherein said first longitudinal length is greater than said second longitudinal length, and wherein said leading edge of said tapering profile is disposed toward a front of the surfboard and wherein said trailing edge of said tapering profile is disposed toward a rear of the surfboard.

2. The drag-reducing surfboard fin of claim 1 wherein said edge includes a radius.

3. The drag-reducing surfboard fin of claim 1 wherein said edge includes a line.

4. The drag-reducing surfboard fin of claim 1 wherein said means for attaching includes a mounting assembly that is attached to an upper end of said planar member, and wherein said mounting assembly is able to permit detachably-attaching the drag-reducing surfboard fin to said bottom of the surfboard.

5. The drag-reducing surfboard fin of claim 1 wherein said at least one opening includes one opening.

6. The drag-reducing surfboard fin of claim 5 wherein said one opening includes a shape, when viewed from either side of said planar member, selected from the group consisting of an arcuate shape, a circle, oval, triangle, square, rectangle, pentagon, trapezoid and polygon.

7. The drag-reducing surfboard fin of claim 5 wherein said one opening includes a shape, when viewed from either side of said planar member, and wherein a first portion of said shape is selected from the group consisting of an arcuate shape, a circle, oval, triangle, square, rectangle, pentagon, trapezoid, and polygon, and wherein a second portion of said shape is selected from the group using a different shape than that of said first portion.

8. The drag-reducing surfboard fin of claim 1 wherein said at least one opening includes a plurality of openings.

9. The drag-reducing surfboard fin of claim 8 wherein each of said openings includes a shape, when viewed from either side of said planar member, selected from the group consisting of an arcuate shape, a circle, oval, triangle, square, rectangle, pentagon, trapezoid and polygon.

10. The drag-reducing surfboard fin of claim 5 wherein said one opening includes a shape, when viewed from either side of said planar member, and wherein a first portion of said shape is selected from the group consisting of an arcuate shape, a circle, oval, triangle, square, rectangle, pentagon, trapezoid and polygon, and wherein a second portion of said shape is selected from the group using a different shape than that of said first portion.

11. The drag-reducing surfboard fin of claim 1 wherein said tapering profile is not uniform around an entire length of said inside perimeter.

12. The drag-reducing surfboard fin of claim 8 wherein a first of said openings from said plurality of openings includes a first shape, when viewed from either side of said planar member, and wherein a second of said openings includes a second shape, when viewed from either side of said planar member, and wherein said second shape is different than said first shape.

13. The drag-reducing surfboard fin of claim 1 wherein said means for attaching includes integrally attaching the drag-reducing surfboard fin to the surfboard.

14. The drag-reducing surfboard fin of claim 13 wherein said drag-reducing surfboard fin is molded as an integral part of the surfboard.

15. The drag-reducing surfboard fin of claim 4 wherein the drag-reducing surfboard fin includes a plurality of drag-reducing surfboard fins, and wherein each of said plurality of drag-reducing surfboard fins includes a different configuration, and wherein said plurality of drag-reducing surfboard fins provides a system for reducing turbulence as desired by permitting the interchangeable use of any of said plurality of drag-reducing surfboard fins on demand.

* * * * *